United States Patent [19]

Long

[11] Patent Number: 4,872,849

[45] Date of Patent: Oct. 10, 1989

[54] CHANNEL OUTLET

[75] Inventor: William B. Long, Camp Hill, Pa.

[73] Assignee: AMP Incorporated, Harrisburg, Pa.

[21] Appl. No.: 678,369

[22] Filed: Dec. 5, 1984

Related U.S. Application Data

[63] Continuation of Ser. No. 396,222, Jul. 8, 1982, abandoned.

[51] Int. Cl.[4] ..... H01R 13/60; H01R 4/24

[52] U.S. Cl. ..... 439/209; 439/211; 439/395; 439/405; 439/557; 439/685; 439/689; 439/736; 439/834; 439/858

[58] Field of Search ..... 339/20, 21 R, 22 R, 339/23, 31 R, 97 R, 164 R, 14 P; 174/48, 49, 70 C, 72 C

[56] References Cited

U.S. PATENT DOCUMENTS

| | | | |
|---|---|---|---|
| 1,641,265 | 9/1927 | Gaynor | 339/164 R |
| 2,252,454 | 8/1941 | Benander | 339/164 R X |
| 3,017,601 | 1/1962 | Benander | 339/164 R X |
| 3,059,204 | 10/1962 | Johnson | 339/22 R X |
| 3,336,560 | 8/1967 | Myers | 339/22 R X |
| 3,848,220 | 11/1974 | Frantz | 339/164 R X |
| 3,860,739 | 1/1975 | Kloth et al. | 174/58 X |
| 3,868,161 | 2/1975 | Frantz | 339/97 R X |
| 4,017,137 | 4/1977 | Parks | 339/21 R |
| 4,113,334 | 9/1978 | Instone | 339/22 R |
| 4,245,880 | 1/1981 | Zimmerman et al. | 339/97 R |
| 4,313,646 | 2/1982 | Millhimes et al. | 339/156 R |

*Primary Examiner*—Steven C. Bishop

*Attorney, Agent, or Firm*—Adrian J. LaRue; Anton P. Ness

[57] ABSTRACT

A channel outlet comprising a housing of insulative material has means for mounting the outlet in an opening in a channel-shaped cover of a channel housing and includes a terminal-receiving member and a cover member. Power terminals and a ground terminal are secured in cavities in the terminal-receiving member. The terminals have a first section adapted to terminate a respective electrical conductor thereto. The power terminals have wrap-around receptacle sections adapted to receive blade terminals of a conventional electrical plug therein. The ground terminal includes a contact member for sliding electrical contact with a ground pin of the electrical plug and a ground tab extending exteriorly of the cover member for ground connection to a channel-shaped base of the channel housing.

8 Claims, 5 Drawing Sheets

CHANNEL OUTLET

This application is a continuation of application Ser. No. 396,222 filed July 8. 1982, now abandoned.

FIELD OF THE INVENTION

This invention relates to electrical outlets and more particularly to channel outlets.

BACKGROUND OF THE INVENTION

Channel outlets are needed on work benches, lab benches, in room areas for connecting electrical equipment to electrical power when required. Commercially-available channel outlets have satisfied this need, but they have presented difficulties in connecting the electrical conductors to the electrical terminals in the channel outlets, the grounding of the ground wire, and the cost of manufacture.

SUMMARY OF THE INVENTION

According to the present invention, a channel outlet comprising a housing of insulative material has means for mounting the outlet in an opening in a channel-shaped cover of a channel housing and includes a terminal-receiving member and a cover member. Power terminals and a ground terminal are secured in cavities in the terminal-receiving member. The terminals have a first section adapted to terminate a respective electrical conductor thereto. The power terminals have wrap-around receptacle sections adapted to receive blade terminals of a conventional electric plug therein. The ground terminal includes a contact member for sliding electrical contact with a ground pin of the electrical plug and a ground tab extending exteriorly of the cover member for ground connection to a channel-shaped base of the channel housing.

DETAILED DESCRIPTION OF A PREFERRED EMBODIMENT

Figure 1:
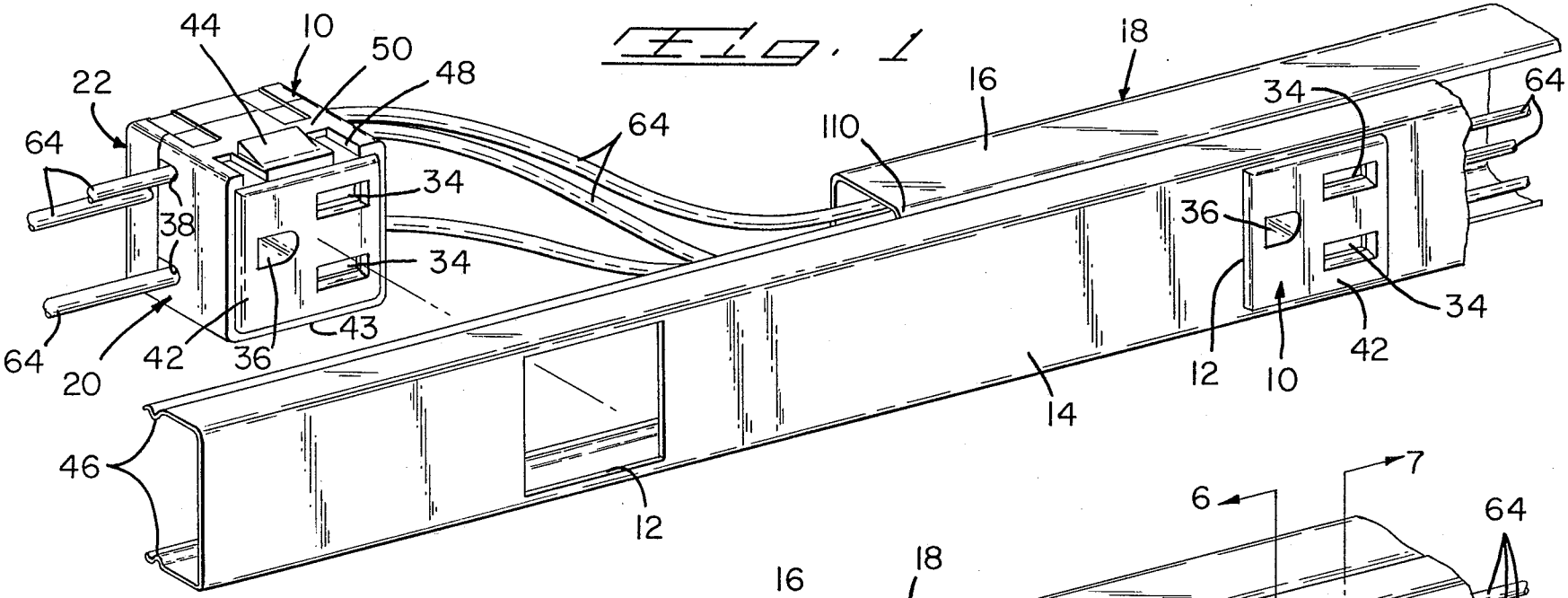
FIG. 1 is a perspective view of a channel housing with a channel outlet in position in an opening of the channel housing and a channel outlet exploded therefrom.
Figure 2:
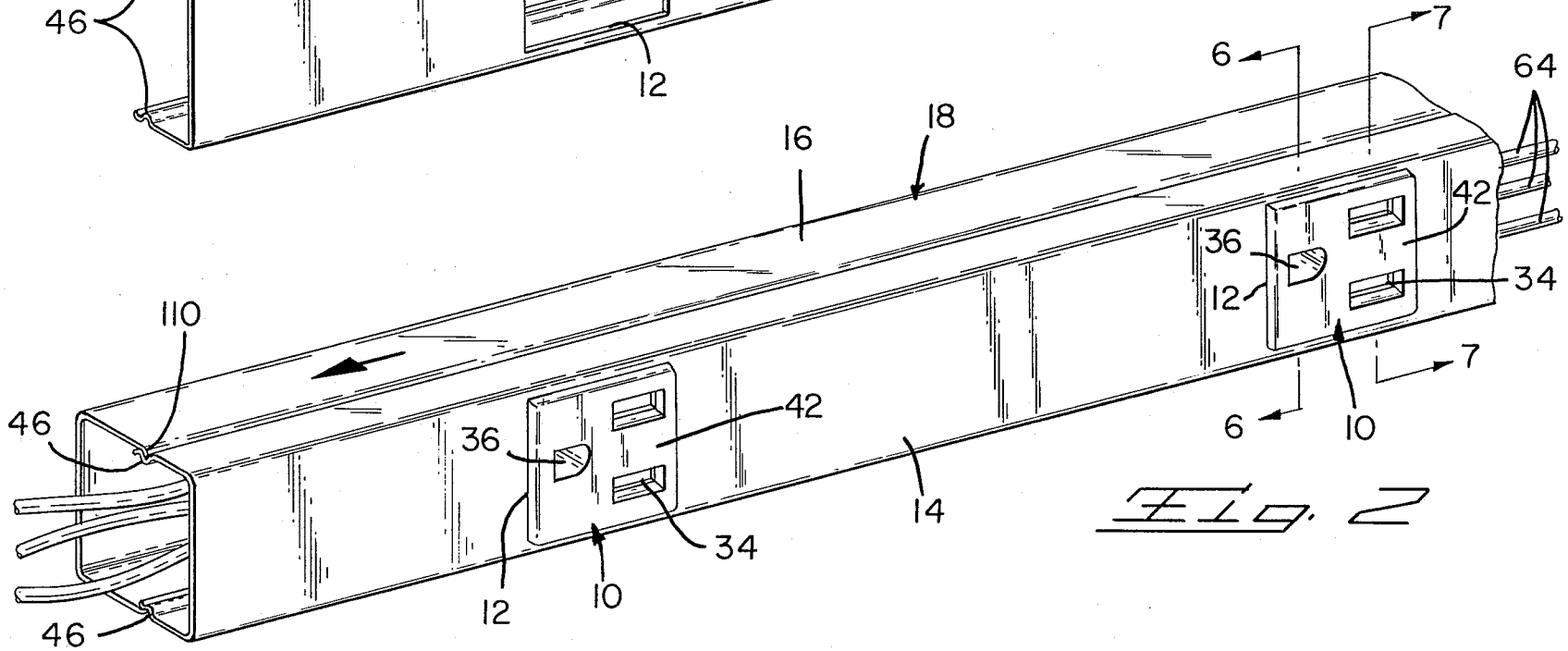
FIG. 2 shows FIG. 1 in an assembled condition.
Figure 3:
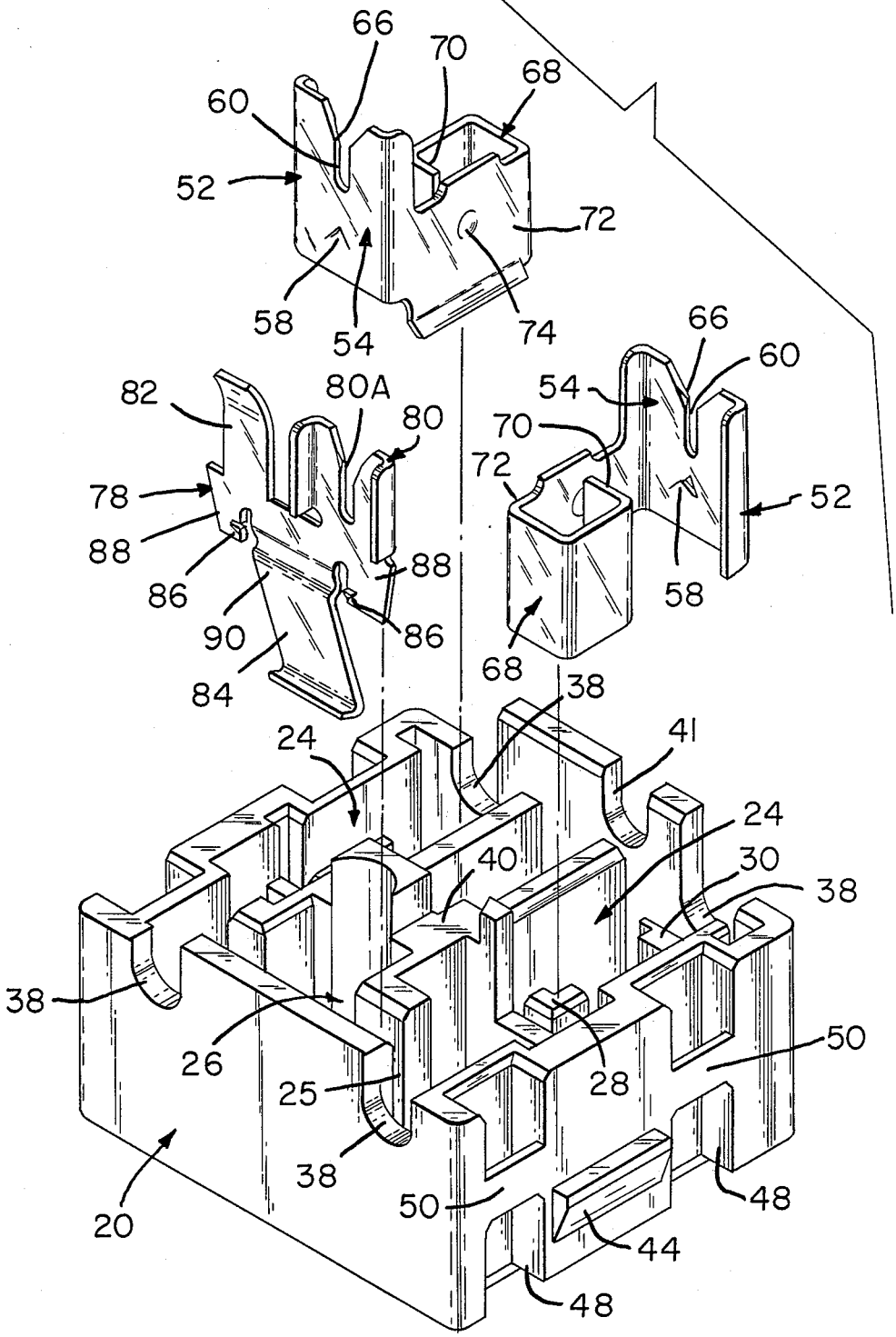
FIG. 3 is a perspective view of the terminal-receiving member of the housing with the power and ground terminals exploded therefrom.
Figure 4:
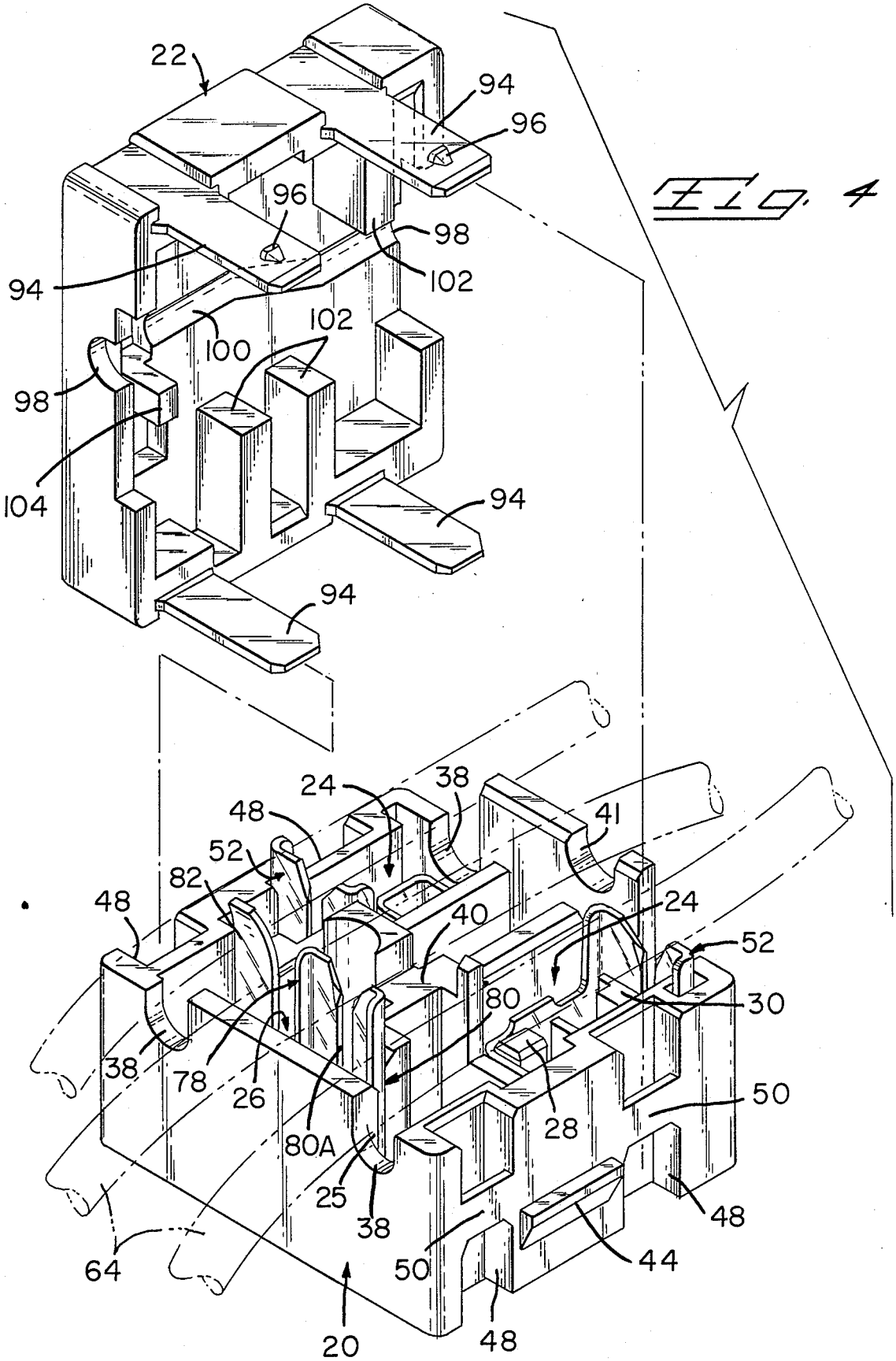
FIG. 4 is a view similar to FIG. 3 with the terminals in position in the terminal-receiving member and the cover member exploded therefrom.

FIGS. 1 and 2 illustrate channel outlets 10 secured in spaced openings 12 of a channel-shaped cover 14 that is slideably or latchably secured to a channel-shaped base 16. Channel-shaped cover 14 and channel-shaped base 16 form a channel housing 18 which can have varying lengths as desired with a desired number of channel outlets 10 disposed therealong.

FIGS. 3 through 8 illustrate the channel outlets in greater detail. Channel outlet 10 includes a terminal-receiving member 20 and a cover member 22 which are molded from a suitable insulation material. Terminal-receiving member 20 is of rigid construction and has power terminal-receiving cavities 24 and a ground terminal-receiving cavity 26. Each of cavities 24 includes an L-shaped member 28, a spaced wall 30, and a projection 32. Rectangular openings 34 having beveled entrances extend through the front of member 20 and communicate with cavities 24. A D-shaped opening 36 is in communication with cavity 26. U-shaped recesses 38 are located in the sides of member 20 in alignment with cavities 24 and recesses 40, 41 are in alignment with cavity 26.

Figure 6:
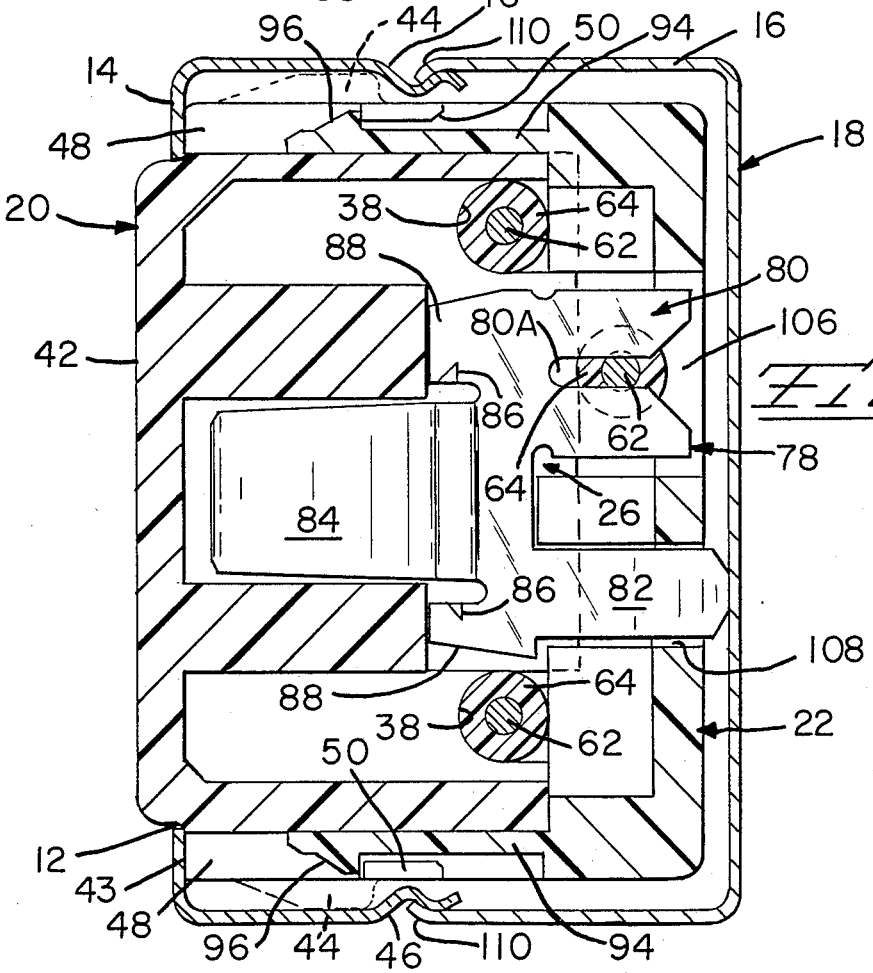
FIG. 6 is a cross-sectional view taken along line 6—6 of FIG. 2.
Figure 7:
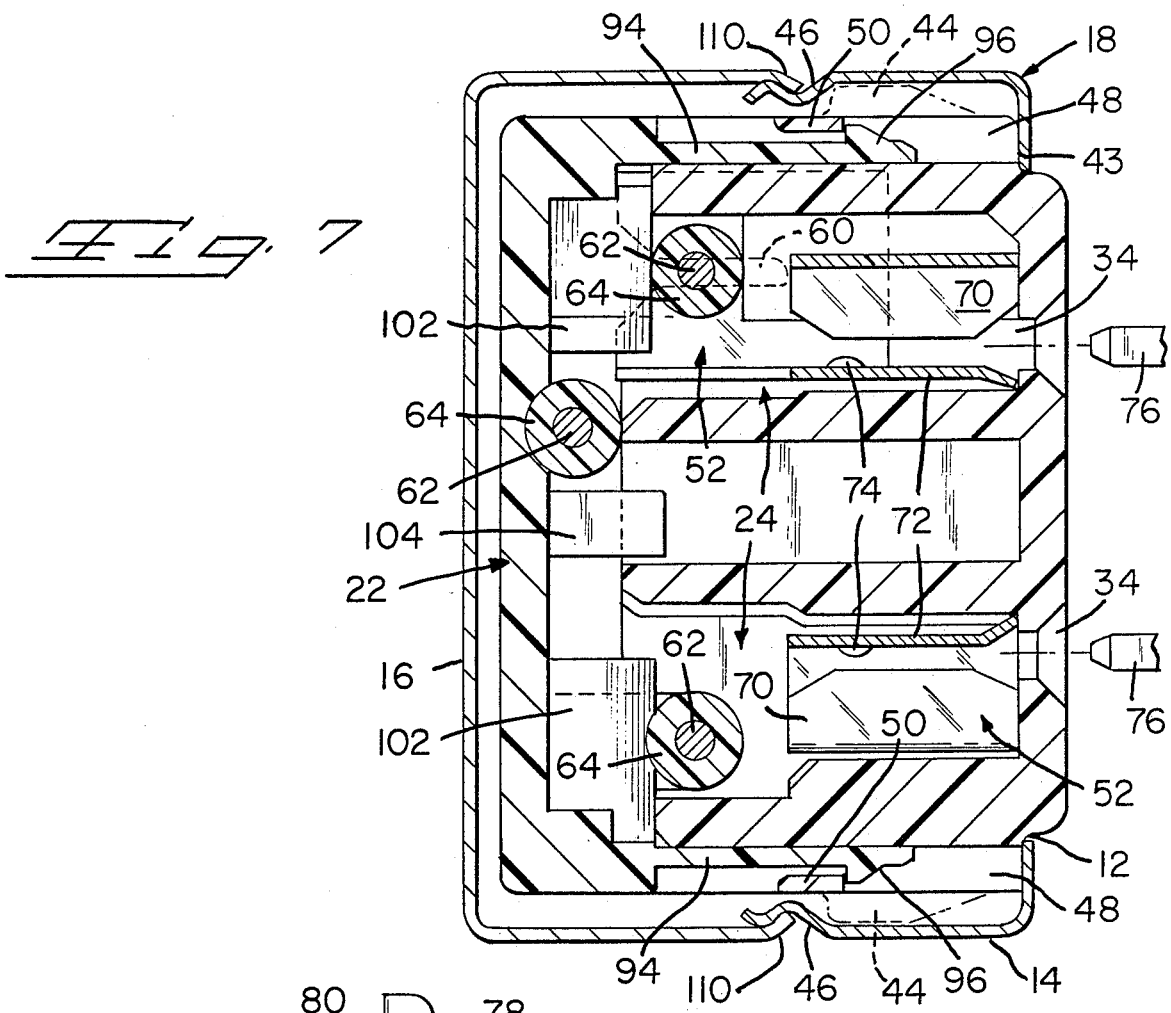
FIG. 7 is a cross-sectional view taken along line 7—7 of FIG. 2.

Terminal-receiving member 20 has a projection 42 which extends through opening 12 in channel-shaped cover 14 while shoulder 43 of member 20 engages the inside surface of channel-shaped cover 14. Wedge-shaped latching members 44 extend outwardly from the sides of terminal-receiving member 20 to facilitate inserting terminal-receiving member 20 into channel-shaped cover 14 and into opening 12 with shoulder 43 engaging the inside surface of cover 14 and the inner ends of latching members 44 being disposed against double-curved outer ends 46 of cover 14 to latchingly retain member 20 in position therein as shown in FIGS. 6 and 7. Recesses 48 are located in opposing sides of member 20 and straps 50 extend thereacross.

Figure 5:
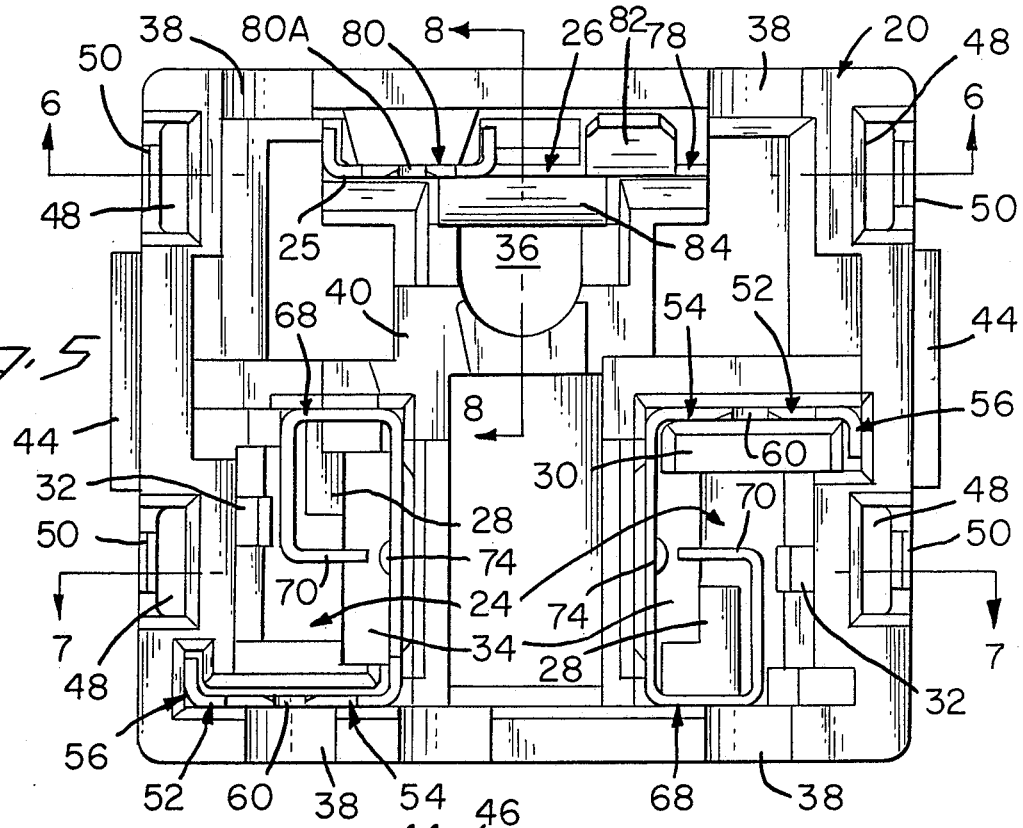
FIG. 5 is a top plan view of the terminal-receiving member of FIG. 4.

Power terminals 52 are stamped and formed and disposed in power terminal-receiving cavities 24 of terminal-receiving member 20 with conductor-terminating sections 54 being disposed in L-shaped recesses 56 along spaced walls 30 as shown in FIG. 5 with triangular-shaped lugs 58 digging into walls 30 to thereby secure power terminals 52 in position therein. Conductor-terminating sections 54 are positioned to receive insulated electrical conductors 64 and include conductor slots 60 having beveled lead-in surfaces to terminate electrical conductors 62 of insulated electrical conductors 64 therein as illustrated in FIG. 7. Transition areas 66 between slots 60 and the lead-in surfaces thereto are chamfered for cutting through the insulation of insulated electrical conductors 64 when they are pushed into conductor slots 60 and they initiate a firm bite into the electrical conductors 62 to ensure large areas of contact as well as cleaning away any stray pieces of insulation.

Wrap-around receptacle sections 68 are almost a box shape with free ends 70 being centrally disposed relative to members 72 and spaced therefrom thereby forming a connection area. Dimples 74 are located in members 72 and the bottoms of members 72 are flared outwardly while the bottoms of free ends 70 opposite the flared-out sections of members 72 are beveled as illustrated in FIG. 7 thereby facilitating the insertion of blades 76 of a conventional electrical plug (not shown) thereinto. This provides excellent mechanical and electrical connection between blades 76 and receptacle sections 68. Wrap-around receptacle sections 68 encompass L-shaped members 28 thereby positioning free ends 70 and dimples 74 centrally of rectangular openings 34 so that blades 76 can be electrically and mechanically connected with receptacle sections 68. Holes (not shown) in blades 76 cooperate with dimples 74. Members 72 are extensions of conductor-terminating sections 54 and provide a large connection area for blades 76 when blades 76 are inserted into the connection area and maintained thereagainst by the spring forces of free ends 70. Projections 32 in cavities 24 and the inside walls of cavities 24 along which members 72 extend limit the movement of free ends 70 and members 72 to assure excellent mechanical and electrical connection with blades 76.

The connection areas of receptacle sections 68 of power terminals 52 are in a plane parallel to the plane extending through slots 60. This offset arrangement enables blades 76 to move along the connection area between members 72 and free ends 70 without any obstruction by the electrical conductors 64 when terminated in conductor-terminating sections 54. This is also true with respect to ground terminal 78 as spring contact 84 is offset with respect to conductor-terminating section 80 thereby enabling pin 92 to contact spring contact 84 free of any engagement with electrical conductor 64 terminated in conductor-terminating section 80.

Figure 8:
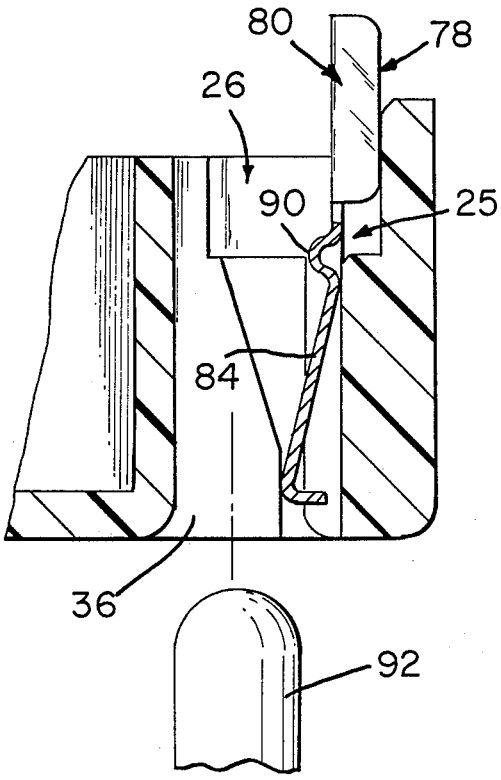
FIG. 8 is a cross-sectional view taken along line 8—8 of FIG. 5.

Ground terminal 78 is stamped and formed and includes a conductor-terminating section 80, a ground contact 82, and a spring contact 84. Sheared areas 86 are provided in extensions 88 to secure ground terminal 78 in a slot 25 in cavity 26 of terminal-receiving member 20 and to limit movement thereinto as illustrated in FIG. 6. Conductor-terminating section 80 is identical to conductor-terminating sections 54 of power terminals 52, and spring contact 84 has its free end curved inwardly and includes an arcuate section 90 to increase its spring characteristics for engagement with a grounding pin 92 of a conventional plug as illustrated in FIG. 8. Ground contact 82 is parallel to section 80.

Cover member 22 is molded from the same material as terminal-receiving member 20 and includes latching leg members extending outwardly therefrom for disposition in recesses 48. Each latching leg member 94 includes a wedge-shaped projection 96 engageable with straps 50 when latching leg members 94 are disposed in recesses 48 thereby latchably securing cover member 22 in position on terminal-receiving member 20. Recesses 98 are located in opposing sides of cover member 22 and in communication with curved channel 100 disposed in the inside surface of cover member 22 to accommodate in electrical conductor therein. Projections 102 operate as pushing members to plush electrical conductors into the conductor-terminating sections 54 of power terminals 52 and cover member 27 operates to force an electrical conductor into conductor-terminating section 80 of ground terminal 78 when cover member 22 is latchably secured onto terminal-receiving member 20. The sides of cover member 20 maintain the electrical conductors within recesses 38, 40 and 41. Projection 104 extends between conductor-terminating section 80 and ground contact 82. Conductor-terminating section 80 is disposed in a slot 106 in cover member 22 and ground contact 82 extends through slot 108 in cover member 22 when cover member 22 is latchably secured onto terminal-receiving member 20 as shown in FIG. 6.

In assembly, channel outlets 10 are positioned in spaced openings 12 of channel-shaped cover 14 and secured therein by means of shoulders 43 engaging cover 14 and wedge-shaped latching members 44 engaging double-curved outer ends 46. With cover members 22 removed from channel housings 18, insulated electrical conductors 64 are positioned in engagement with the beveled lead-in surfaces to slots 60 and 80A of conductor-terminating sections 54 and 80 whereafter cover members 22A are pushed into latching positions on terminal-receiving members 20 thereby forcing insulated electrical conductors 64 into slots 60 and 80A, causing transition areas 66 to cut through the insulation of the insulated electrical conductors 64 and make electrical connection with electrical conductors 62. Channel-shaped base 16 is then snapped into position on channel-shaped cover 14 by inwardly-curved ends 110 engaging outer ends 46. Ground contacts 82 make electrical connection with base 16 thereby grounding each of the channel outlets. Thus, a channel housing 18 with spaced channel outlets 10 positioned in openings 12 therealong and electrically connected together via terminated connections to insulated electrical conductors 64 with ground terminals of the outlets grounded to housing 18 is effected.

I claim:

1. A channel outlet electrical connector assembly, comprising:

channel-housing means including cover means and base means, said cover means having spaced openings therealong, means maintaining said cover means and said base means together;

channel outlet means disposed in said channel-housing means at each of said openings and including terminal-housing means and cover member means of rigid insulative material, said terminal-housing means having power terminal-receiving cavities and a ground terminal-receiving cavity therein, a front section of each of the terminal-housing means disposed in respective spaced openings of said cover means of said channel-housing means and having apertures therethrough leading to the respective terminal-receiving cavities, means provided by said channel outlet means and said channel-housing means securing said channel outlet means in the respective spaced openings of said cover means;

power terminal means respectively disposed in said power terminal-receiving cavities and ground terminal means disposed in said ground terminal-receiving cavity, said power terminal means and said ground terminal means have conductor-terminating means including slots therein positioned adjacent an inner end of said terminal-housing means, wherein insulated electrical conductors are respectively terminated in said conductor-terminating means upon said conductors being pushed into the respective slots so that the slotted conductor-terminating means cut through the insulation and electrically connect with the electrical conductor, said power terminal means having receptacle section means in alignment with respective apertures, said ground terminal means having spring contact means extending along said ground terminal-receiving cavity toward the aperture in alignment therewith and ground contact means extending substantially parallel with respect to said conductor-terminating means of said ground terminal means, said apertures in alignment with said receptacle section means and said spring contact means being offset from the respective conductor-terminating means of said power terminal means and said ground terminal means so that the electrical conductors terminated in the respective conductor-terminating means are positioned to the side of the respective apertures;

means provided by said terminal means and said terminal-housing means securing said power terminal means in said power terminal-receiving cavities and said ground terminal means in said ground terminal-receiving cavity opposite outer surfaces of said terminal-housing being formed with depressed open channels therein, a strap member extending across the mouth of each of the channels intermediate its ends, said cover member having a plurality of spaced leg members extending from the rim thereof to respectively slide along the channels when the cover is moved to close the housing, said legs having protruding wedge-shaped portions engageable with the strap members to latch the cover in place, said cover member means having an opening through which said ground contact means extends and electrically connects with said base means.

2. A channel outlet electrical connector assembly as set forth in claim 1, wherein aligned U-shaped recesses are located in opposed sides of said terminal-housing means which are in alignment with respective conductor-terminating means of said power terminal means and in which the electrical conductors are disposed.

3. A channel outlet electrical connector as set forth in claim 1, wherein a U-shaped recess is located in one side of the terminal-housing means substantially in alignment with the conductor-terminating means of said ground terminal means in which the electrical conductor terminated therein is disposed, and said cover member means has a channel along an inside surface thereof in alignment with recesses in opposed sides of said cover member means so that the electrical conductor terminated in the conductor-terminating means of the ground terminal means is disposed therein.

4. A channel outlet connector assembly as set forth in claim 1, wherein projections are located along an inside surface of said cover member means for engaging the electrical conductors and pushing them into the slots of the respective conductor-terminating means of said power terminal means when the cover member means is latchably secured onto the terminal-housing means.

5. A channel outlet electrical connector to be secured in an opening of a channel housing and to be electrically connected to insulated power and ground conductors in the channel housing, said connector comprising:

housing means including terminal-housing means and cover means of rigid insulative material, said terminal-housing means having power terminal-receiving cavities and a ground terminal-receiving cavity therein, a front section of said terminal-housing means is to be disposed in the opening of the channel housing and has apertures therethrough leading to the respective terminal-receiving cavities, means provided by said housing means and the channel housing for securing in the opening thereof;

power terminal means respectively disposed in said power terminal-receiving cavities and ground terminal means disposed in said ground terminal-receiving cavity, said power terminal means and said ground terminal means have conductor-terminating means including slots therein positioned adjacent an inner end of said terminal-housing means for electrical termination with the respective insulated power and ground conductors, when the conductors are pushed into the respective slots so that the slotted conductor-terminating means cut through the insulation and electrically connect with the electrical conductors, said power terminal means having receptacle section means in alignment with respective apertures, said ground terminal maens having spring contact means extending along said ground terminal-receiving cavity toward the aperture in alignment therewith and ground contact means extending substantially parallel with respect to said conductor-terminating means of said ground terminal means, said apertures in alignment with said receptacle section means and said spring contact means being offset from the respective conductor-terminating means of said power-terminal means and said ground terminal means so that the electrical conductors to be terminated in the respective conductor-terminating means are positioned to the side of the respective apertures;

means provided by said terminal-housing means and said terminal means securing said power terminal means in said power terminal-receiving cavities and said ground terminal means in said ground terminal-receiving cavity opposite outer surfaces of said terminal-housing being formed with depressed open channels therein, a strap member extending across the mouth of each of the channels intermediate its ends, said cover member having a plurality of spaced leg members extending from the rim thereof to respectively slide along the channels when the cover is moved to close the housing, said legs having protruding wedge-shaped portions engageable with the strap members to latch the cover in place, said cover means having an opening through which said ground contact means extends to electrically connect with the channel housing.

6. A channel outlet electrical connector assembly as set forth in claim 5, wherein aligned U-shaped recesses are located in opposed sides of said terminal-housing means which are in alignment with respective conductor-terminating means of said power terminal means and in which the electrical conductors are disposed.

7. A channel outlet electrical connector as set forth in claim 5, wherein a U-shaped recess is located in one side of the terminal-housing means substantially in alignment with the conductor-terminating means of said ground terminal means in which the electrical conductor terminated therein is disposed, and said cover means has a channel along an inside surface thereof in alignment with recesses in opposed sides of said cover means so that the electrical conductor terminated in the conductor-terminating means of the ground terminal means is disposed therein.

8. A channel outlet connector assembly as set forth in claim 5, wherein projections are located along an inside surface of said cover means for engaging the electrical conductors and pushing them into the slots of the respective conductor-terminating means of said power terminal means when the cover means is latchably secured onto the terminal-housing means.

* * * * *

UNITED STATES PATENT OFFICE

CERTIFICATE OF CORRECTION

Patent No. 4,872,849 Dated October 10, 1989

Inventor(s) William B. Long

It is certified that error appears in the above-identified patent and that said Letters Patent is hereby corrected as shown below:

In the Claims:

Claim 1, Column 5, Line 4 - insert --means-- after "terminal-housing".

Claim 1, Column 5, Line 7 - insert --means-- after the word "member".

Claim 1, Column 5, Line 10 - insert --member means-- after "cover".

Claim 1, Column 5, Line 10 - change "housing" to read --terminal-housing means--.

Claim 1, Column 5, Line 11 - change the word "legs" to --leg members--.

Claim 1, Column 5, Line 13 - insert --means-- after first occurrence of the word "cover".

Claim 5, Column 6, Line 7 - the word "maens" should be --means--.

Claim 5, Column 6, Line 26 - insert --means-- after the word "terminal-housing"

Claim 5, Column 6, Line 29 - the word "member" should be --means--.

Claim 5, Column 6, Line 32 - insert --means-- after the word "cover".

Claim 5, Column 6, Line 32 - change "housing" to read --terminal-housing means--.

UNITED STATES PATENT AND TRADEMARK OFFICE

CERTIFICATE OF CORRECTION

PATENT NO. : 4,872,849

DATED : October 10, 1989

INVENTOR(S) : William B. Long

It is certified that error appears in the above-identified patent and that said Letters Patent is hereby corrected as shown below:

Claim 5, Column 6, Line 33 - change the word "legs" to --leg members--.

Claim 5, Column 6, Line 35 - insert the word --means-- after the word "cover".

Signed and Sealed this

Fourteenth Day of May, 1991

*Attest:*

HARRY F. MANBECK, JR.

*Attesting Officer*

*Commissioner of Patents and Trademarks*